US007914130B2

(12) United States Patent
Kijima et al.

(10) Patent No.: US 7,914,130 B2
(45) Date of Patent: Mar. 29, 2011

(54) DROPLET EJECTION DEVICE AND PRINTER

(75) Inventors: Takeshi Kijima, Saitama (JP); Shoichi Iino, Nirasaki (JP)

(73) Assignee: Seiko Epson Corporation (JP)

( * ) Notice: Subject to any disclaimer, the term of this patent is extended or adjusted under 35 U.S.C. 154(b) by 134 days.

(21) Appl. No.: 12/398,351

(22) Filed: Mar. 5, 2009

(65) Prior Publication Data

US 2009/0225139 A1 Sep. 10, 2009

(30) Foreign Application Priority Data

Mar. 6, 2008 (JP) ..... 2008-056891

(51) Int. Cl.
*B41J 2/045* (2006.01)

(52) U.S. Cl. ..... 347/72

(58) Field of Classification Search ..... 347/72, 347/68–71; 400/124.14, 124.16; 310/311, 310/324, 327, 358, 365
See application file for complete search history.

(56) References Cited

FOREIGN PATENT DOCUMENTS

| | | |
|---|---|---|
| JP | 05-193129 | 8/1993 |
| JP | 09-150508 | 6/1997 |
| JP | 2002-086716 | 3/2002 |
| JP | 2005-034997 | 2/2005 |

*Primary Examiner* — K. Feggins
(74) *Attorney, Agent, or Firm* — Harness, Dickey & Pierce, P.L.C.

(57) ABSTRACT

A droplet ejection device includes: a substrate having first, second, third & fourth pressure chambers extending in a first direction; a nozzle plate below the substrate & having first, second, third & fourth nozzle apertures continuous with first, second, third & forth pressure chambers, respectively; a vibration plate above the substrate; first, second, third & fourth piezoelectric elements above the vibration plate & above first, second, third & fourth pressure chambers. wherein, viewed in a second direction orthogonal to the first direction, the first nozzle aperture positioned to overlap the third nozzle aperture & doesn't overlap the second & fourth nozzle apertures; the second nozzle aperture overlaps the fourth nozzle aperture & doesn't overlap the first & third nozzle apertures, viewed in the second direction; the first piezoelectric element positioned to overlap the third piezoelectric element & doesn't overlap the second & fourth piezoelectric elements, viewed in the second direction; & the second piezoelectric element overlaps the fourth piezoelectric element & doesn't overlap the first & third piezoelectric elements.

10 Claims, 4 Drawing Sheets

DROPLET EJECTION DEVICE AND PRINTER

CROSS-REFERENCE TO RELATED APPLICATION

This application claims a priority to Japanese Patent Application No. 2008-056891 filed on Mar. 6, 2008 which is hereby expressly incorporated by reference herein in its entirety.

BACKGROUND

1. Technical Field

The present invention relates to droplet ejection devices and printers using the same.

2. Related Art

As droplet ejection heads for discharging liquid, inkjet heads that may be mounted, for example, on an ink jet recording apparatus are known. Inkjet heads may be operated in a manner that pressure chambers communicating with nozzle apertures are pressurized by piezoelectric elements thereby ejecting ink droplets through the nozzle apertures. As the piezoelectric elements, laminate type piezoelectric elements formed from alternately laminated piezoelectric layers and electrode layers are known (see, for example, Japanese Laid-open Patent Application JP-A-5-193129). With droplet ejection devices that use piezoelectric elements of the type described above, it is difficult to reduce the size of the piezoelectric elements, which makes it difficult to arrange nozzle apertures at higher density.

SUMMARY

In accordance with an advantage of some aspects of the invention, it is possible to provide droplet ejection devices that can achieve high-density arrangement of nozzles when piezoelectric elements are used. Also, droplet ejection heads and printers that use the droplet ejection devices can be provided.

A droplet ejection device in accordance with an embodiment of the invention includes a substrate having a first pressure chamber, a second pressure chamber, a third pressure chamber and a fourth pressure chamber extending in a first direction; a nozzle plate provided below the substrate, and having a first nozzle aperture continuous with the first pressure chamber, a second nozzle aperture continuous with the second pressure chamber, a third nozzle aperture continuous with the third pressure chamber, and a fourth nozzle aperture continuous with the fourth pressure chamber; a vibration plate provided above the substrate; a first piezoelectric element provided above the vibration plate and above the first pressure chamber; a second piezoelectric element provided above the vibration plate and above the second pressure chamber; a third piezoelectric element provided above the vibration plate and above the third pressure chamber; and a fourth piezoelectric element provided above the vibration plate and above the fourth pressure chamber, wherein, as viewed in a second direction orthogonal to the first direction, the first nozzle aperture is provided at a position that overlaps the third nozzle aperture, and provided at a position that does not overlap the second nozzle aperture and the forth nozzle aperture; the second nozzle aperture is provided at a position that overlaps the fourth nozzle aperture, and provided at a position that does not overlap the first nozzle aperture and the third nozzle aperture, as viewed in the second direction; the first piezoelectric element is provided at a position that overlaps the third piezoelectric element, and provided at a position that does not overlap the second piezoelectric element and the fourth piezoelectric element, as viewed in the second direction; and the second piezoelectric element is provided at a position that overlaps the fourth piezoelectric element, and provided at a position that does not overlap the first piezoelectric element and the third piezoelectric element.

According to the droplet ejection device in accordance with the embodiment described above, droplets can be effectively ejected.

In the description of the invention, the term "above" is used, for example, as in a statement "a specific component (hereinafter called 'B') is formed 'above' another specific component (hereinafter called 'A')." In such a case, the term "above" is used in the description of the invention, while assuming to include the case where the component B is formed directly on the component A and the case where the component B is formed over the component A through another component provided on the component A. Similarly, the term "below" is used, while assuming to include the case where the component B is formed directly under in contact with the component A and the case where the component B is formed under the component A through another component.

In the droplet ejection device in accordance with an aspect of the invention, the first nozzle aperture may be provided at a position that does not overlap the second piezoelectric element and the fourth piezoelectric element, as viewed in the second direction, and the second nozzle aperture may be provided at a position that does not overlap the first piezoelectric element and the third piezoelectric element, as viewed in the second direction.

In the droplet ejection device in accordance with an aspect of the invention, the second pressure chamber may have a long side and a short side, as viewed in a plan view, the distance between the first piezoelectric element and the third piezoelectric element may be the same as the length of the short side of the second pressure chamber, as viewed in the first direction in a plan view; and the third pressure chamber may have a long side and a short side, as viewed in a plan view, the distance between the second piezoelectric element and the fourth piezoelectric element may be the same as the length of the short side of the third pressure chamber, as viewed in the first direction in a plan view.

In the droplet ejection device in accordance with an aspect of the invention, the substrate may further include a reservoir; a first dam section that is provided in the first pressure chamber and provided at a flow inlet section where liquid flows from the reservoir to the first pressure chamber; a second dam section that is provided in the second pressure chamber and provided at a flow inlet section where liquid flows from the reservoir to the second pressure chamber; a third dam section that is provided in the third pressure chamber and provided at a flow inlet section where liquid flows from the reservoir to the third pressure chamber; and a fourth dam section that is provided in the fourth pressure chamber and provided at a flow inlet section where liquid flows from the reservoir to the fourth pressure chamber.

In the droplet ejection device in accordance with an aspect of the invention, the substrate may further include; a first dam section provided in the first pressure chamber; a second dam section provided in the second pressure chamber; a third dam section provided in the third pressure chamber; and a fourth dam section provided in the fourth pressure chamber, wherein the first dam section, the second dam section, the third dam section and the fourth dam section may be provided at the same position, as viewed in the second direction.

In the droplet ejection device in accordance with an aspect of the invention, the first pressure chamber may have a long side and a short side, as viewed in a plan view, the second pressure chamber may have a long side and a short side, as viewed in a plan view, the third pressure chamber may have a long side and a short side, as viewed in a plan view, and the fourth pressure chamber may have a long side and a short side, as viewed in a plan view, wherein the long side of the first pressure chamber may have the same length as the long side of the third pressure chamber, the long side of the second pressure chamber may have the same length as the long side of the fourth pressure chamber, and the long side of the first pressure chamber may be longer than the long side of the second pressure chamber.

In the droplet ejection device in accordance with an aspect of the invention, the first piezoelectric element may have a long side and a short side, as viewed in a plan view, the second piezoelectric element may have a long side and a short side, as viewed in a plan view, the third piezoelectric element may have a long side and a short side, as viewed in a plan view, and the fourth piezoelectric element may have a long side and a short side, as viewed in a plan view, wherein the short side of the first piezoelectric element may be longer than the short side of the first pressure chamber, the short side of the second piezoelectric element may be longer than the short side of the second pressure chamber, the short side of the third piezoelectric element may be longer than the short side of the third pressure chamber, and the short side of the fourth piezoelectric element may be longer than the short side of the fourth pressure chamber.

In the droplet ejection device in accordance with an aspect of the invention, the vibration plate may include, above the vibration plate, a first protrusion located below the first piezoelectric element, a second protrusion located below the second piezoelectric element, a third protrusion located below the first piezoelectric element, and a fourth protrusion located below the first piezoelectric element.

In the droplet ejection device in accordance with an aspect of the invention, the first protrusion may be formed in the first piezoelectric element, as viewed in a plan view, the second protrusion may be formed in the second piezoelectric element, as viewed in a plan view, the third protrusion may be formed in the third piezoelectric element, as viewed in a plan view, and the fourth protrusion may be formed in the fourth piezoelectric element, as viewed in a plan view.

In the droplet ejection device in accordance with an aspect of the invention, the first piezoelectric element may be provided at the same position as the third piezoelectric element, as viewed in the second direction, and the second piezoelectric element may be provided at the same position as the fourth piezoelectric element, as viewed in the second direction.

A droplet ejection device in accordance with an embodiment of the invention includes a substrate having a first pressure chamber, a second pressure chamber, a third pressure chamber and a fourth pressure chamber extending in a first direction; a nozzle plate provided below the substrate, and having a first nozzle aperture continuous with the first pressure chamber, a second nozzle aperture continuous with the second pressure chamber, a third nozzle aperture continuous with the third pressure chamber, and a fourth nozzle aperture continuous with the fourth pressure chamber; a vibration plate provided above the substrate; a first piezoelectric element provided above the vibration plate and above the first pressure chamber; a second piezoelectric element provided above the vibration plate and above the second pressure chamber; a third piezoelectric element provided above the vibration plate and above the third pressure chamber; and a fourth piezoelectric element provided above the vibration plate and above the fourth pressure chamber, wherein, as viewed in a second direction orthogonal to the first direction, the first piezoelectric element is provided at a position that overlaps the third piezoelectric element, and the second piezoelectric element is provided at a position that overlaps the fourth piezoelectric element, as viewed in the second direction.

A droplet ejection device in accordance with an embodiment of the invention includes a substrate having a first pressure chamber, a second pressure chamber, a third pressure chamber and a fourth pressure chamber extending in a first direction; a nozzle plate provided below the substrate, and having a first nozzle aperture continuous with the first pressure chamber, a second nozzle aperture continuous with the second pressure chamber, a third nozzle aperture continuous with the third pressure chamber, and a fourth nozzle aperture continuous with the fourth pressure chamber; a vibration plate provided above the substrate; a first piezoelectric element provided above the vibration plate and above the first pressure chamber; a second piezoelectric element provided above the vibration plate and above the second pressure chamber; a third piezoelectric element provided above the vibration plate and above the third pressure chamber; and a fourth piezoelectric element provided above the vibration plate and above the fourth pressure chamber, wherein, as viewed in a second direction orthogonal to the first direction, the first nozzle aperture is provided at a position that overlaps the third nozzle aperture, and the second nozzle aperture is provided at a position that overlaps the fourth nozzle aperture, as viewed in the second direction.

A printer in accordance with an embodiment of the invention includes any one of the droplet ejection devices described above.

DESCRIPTION OF EXEMPLARY EMBODIMENTS

Preferred embodiments of the invention are described below with reference to the accompanying drawings.

1. Droplet Ejection Device

Figure 1:
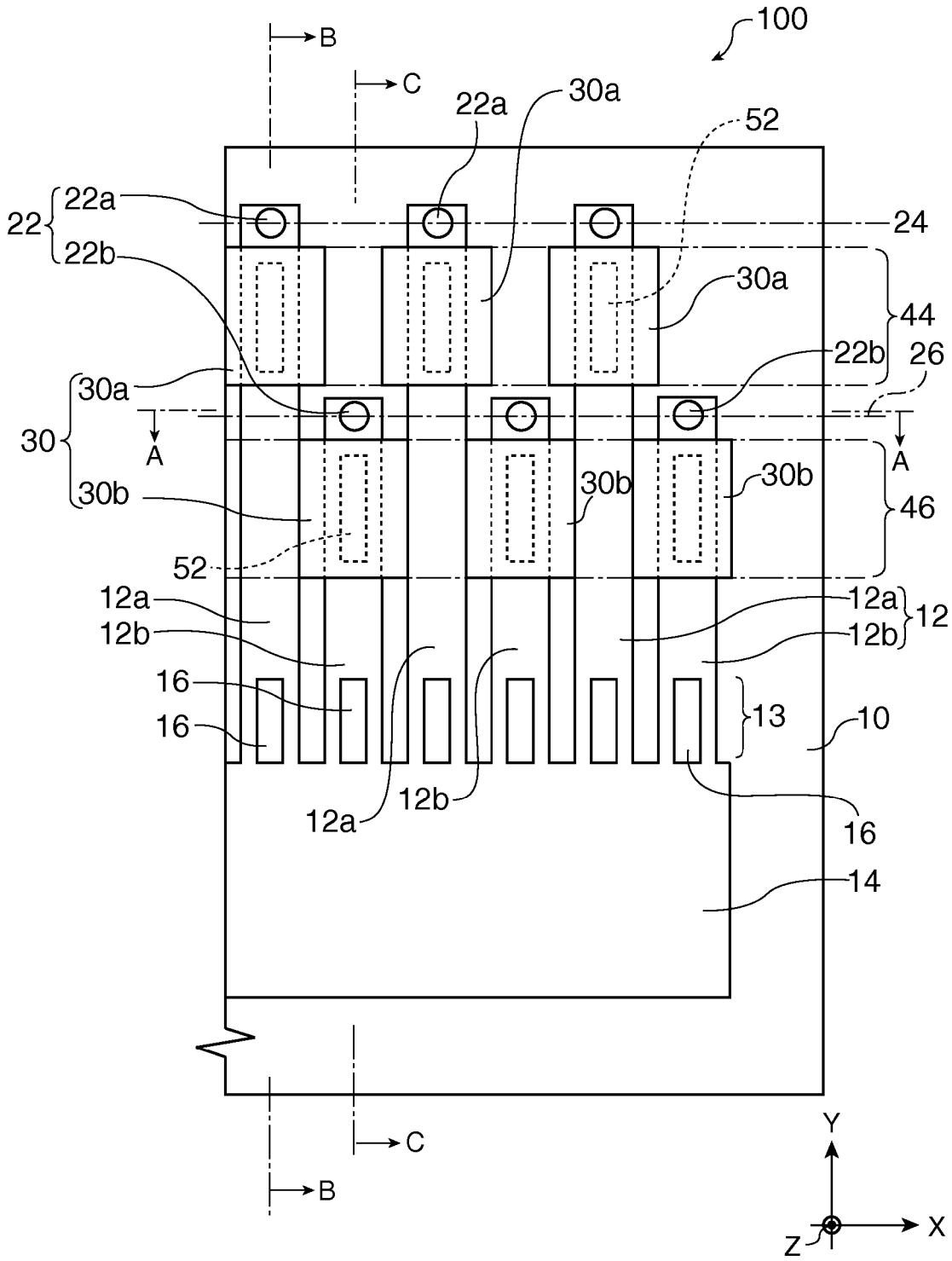
FIG. 1 is a schematic plan view of a droplet ejection device in accordance with an embodiment of the invention.
Figure 2:
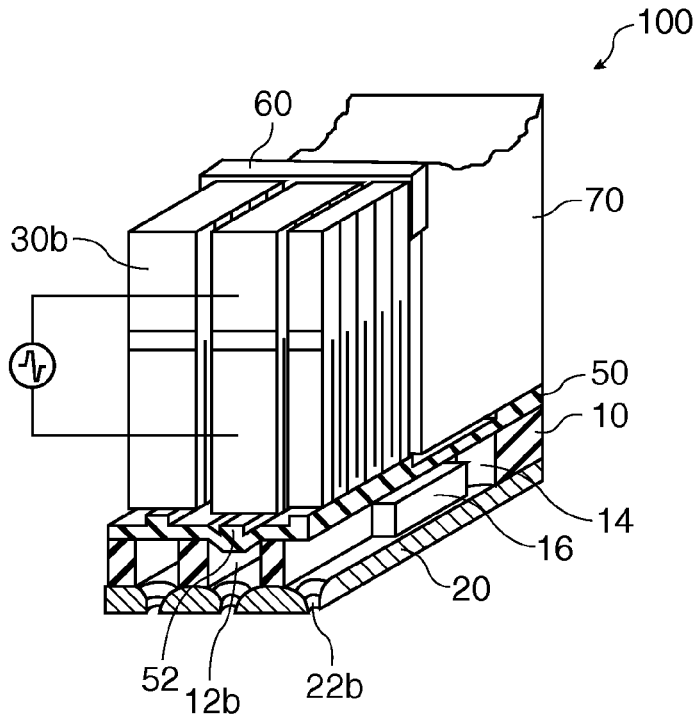
FIG. 2 is a perspective view of the droplet ejection device showing the state thereof as being cut along a line A-A in FIG. 1.
Figure 3:
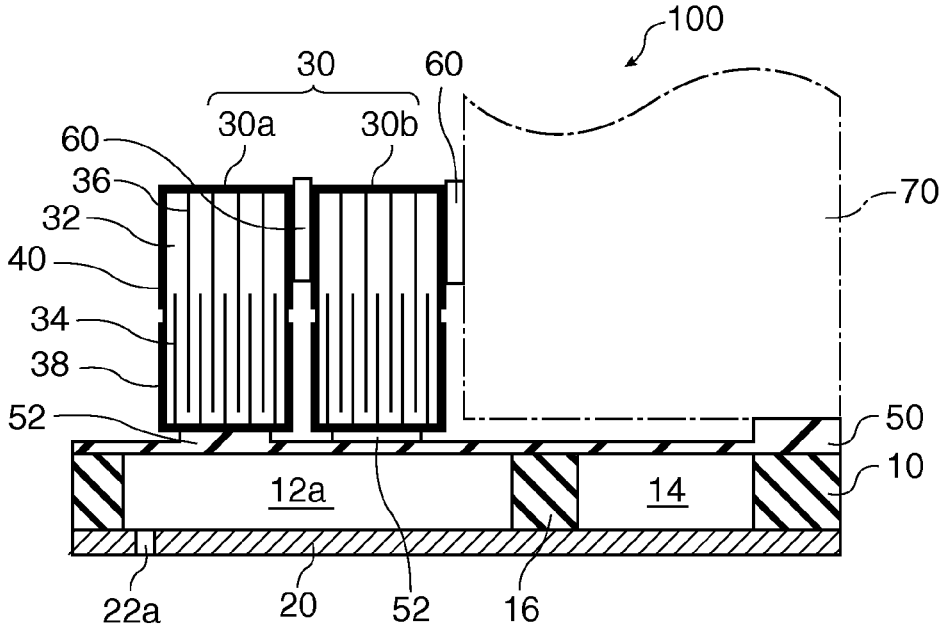
FIG. 3 is a cross-sectional view taken along a line B-B in FIG. 1.
Figure 4:
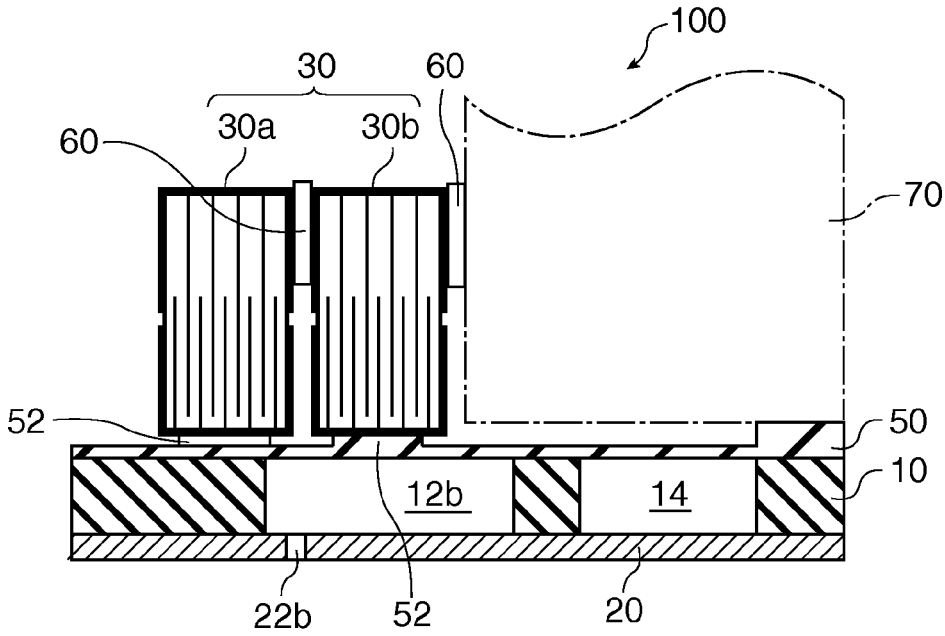
FIG. 4 is a cross-sectional view taken along a line C-C in FIG. 1.
Figure 5:
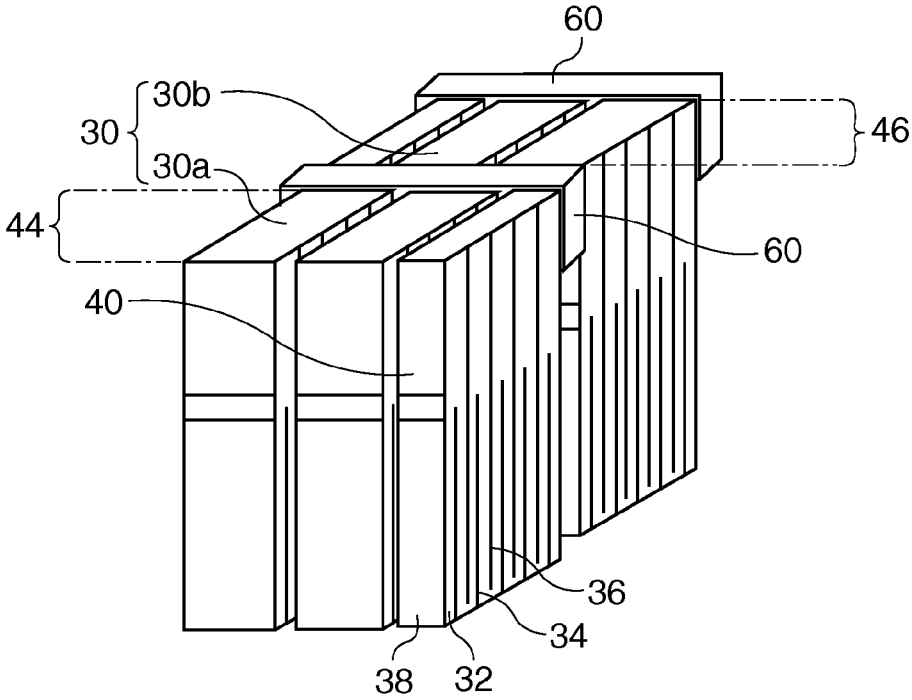
FIG. 5 is a perspective view showing a state of arrangement of piezoelectric elements.

FIGS. 1 through 5 are schematic views of a droplet ejection device 100 in accordance with an embodiment of the invention. FIG. 1 is a plan view in part of the droplet ejection device 100. FIG. 2 is a perspective view showing the state of the droplet ejection device 100 which is cut along a line A-A in FIG. 1. FIG. 3 is a cross-sectional view taken along a line B-B in FIG. 1. FIG. 4 is a cross-sectional view taken along a line C-C in FIG. 1. FIG. 5 is a perspective view of piezoelectric elements. It is noted that FIG. 1 does not illustrate a vibration plate.

The droplet ejection device 100 has, as shown in FIG. 1 through FIG. 4, a substrate 10, a nozzle plate 20 provided below the substrate 10, a vibration plate 50 provided on the substrate 10, and piezoelectric elements 30 provided on the vibration plate 50.

The substrate 10 may include pressure chambers 12, a reservoir 14 continuous with the pressure chambers 12, and dam sections 16. The pressure chambers 12 and the reservoir 14 may be formed by dividing the space between the nozzle plate 20 and the vibration plate 50 by the substrate 10. An area where each dam section 16 is formed has a narrow flow path connecting between the reservoir 14 and each pressure chamber 12. This area is called a flow inlet section 13. The reservoir 14 is capable of storing liquid supplied from outside through an unshown liquid supply aperture. The liquid is supplied from the reservoir 14 to each pressure chamber 12 through the flow inlet section 13.

The pressure chambers 12 extend in a first direction (a Y direction in FIG. 1). Also, each of the pressure chambers 12 may be composed of an elongated space having a long side and a short side. Also, in the illustrated example, first pressure chambers 12*a* each having a first long side, and second pressure chambers 12*b* each having a long side shorter than the first long side of the first pressure chamber 12*a* are alternately disposed. The number of the pressure chambers 12 is not particularly limited.

Each of the pressure chambers 12 may have a columnar dam section 16 for controlling the flow quantity of liquid. The dam section 16 may be provided between the piezoelectric element 30 and the reservoir 14, as viewed in a plan view. In the illustrated example, the dam sections 16 are provided in proximity of the reservoir 14. The dam sections 16 are capable of controlling the speed of liquid supply to the pressure chambers 12, respectively, and also capable of controlling the speed of liquid that returns from the pressure chambers 12 to the reservoir 14 upon deformation of the pressure chambers 12, respectively. Also, the positions of the dam sections 16 are not limited to those in the illustrated example, but may be suitably changed for controlling the liquid flow. For example, the dam sections 16 may be positioned at different locations in the first pressure chamber 12*a* and the second pressure chamber 12*b*, respectively.

The substrate 10 may be composed of, for example, a (110) single crystal silicon substrate. The (110) single crystal silicon substrate may be accurately processed by anisotropic etching with a potassium hydroxide solution or the like. In accordance with the present embodiment, the pressure chambers 12, the dam sections 16 and the reservoir 14 can be accurately formed through processing the substrate 10.

The nozzle plate 20 has nozzle apertures 22 that are continuous with the pressure chambers 12 of the substrate, respectively, as shown in FIG. 1, FIG. 3 and FIG. 4. More specifically, the nozzle apertures 22 include first nozzle apertures 22*a* that are continuous with the first pressure chambers 12*a*, respectively, and second nozzle apertures 22*b* that are continuous with the second pressure chambers 12*b*, respectively. The first nozzle apertures 22*a* are arranged at equal intervals in a second direction (an X direction in FIG. 1). A line of the first nozzle apertures 22*a* is referred to as a first nozzle line 24. Similarly, the second nozzle apertures 22*b* are arranged at equal intervals in the X direction. A line of the second nozzle apertures 22*b* is referred to as a second nozzle line 26.

In accordance with the present embodiment, the first nozzle line 24 and the second nozzle line 26, i.e., two lines of nozzle apertures are provided in a Y direction. Further, the first nozzle apertures 22*a* of the first nozzle line 24 and the second nozzle apertures 22*b* of the second nozzle line 26 are provided in a way mutually shifted in the X direction. In other words, the first nozzle apertures 22*a* and the second nozzle apertures 22*b* are arranged in a so-called staggered fashion. Also, when projected onto a plane extending in a direction orthogonal to the X direction and the Y direction (i.e., a Z direction in FIG. 1), the first nozzle apertures 22*a* and the second nozzle apertures 22*b* are arranged at equal intervals. Accordingly, in accordance with the present embodiment, the pitch of the nozzle apertures 22*a* and 22*b* can be reduced in half, compared to the case where only a single line of nozzle apertures is provided, such that nozzle arrangement at higher density can be achieved.

The vibration plate 50 includes protrusions 52. Piezoelectric elements 30 are provided on the protrusions 52, respectively. Each of the protrusions 52 is located inside the outer periphery of each of the piezoelectric elements 30, as viewed in a plan view. Due to the protrusions 52, pressure caused by deformation of the piezoelectric elements 30 can be effectively transmitted to the vibration plate 50. As the material for the vibration plate 50, any material can be used without any particular limitation as long as it can be deformed by the piezoelectric elements 30, and plastic material, metal or the like may be used. Also, the protrusions 52 may be formed from a material different from the material composing the entire vibration plate 50 (the vibration plate main body). For example, the vibration plate main body may be formed from a plastic material, and the protrusions 52 may be formed from a metal.

In the illustrated example, each of the piezoelectric elements 30 is a piezoelectric element of the type in which piezoelectric layers are laminated among multiple electrodes, and is characterized in that it deforms upon application of a voltage. The piezoelectric element 30 has, for example, as shown in FIG. 3 through FIG. 5, piezoelectric layers 32, first electrodes 34 and second electrodes 36. The first electrodes 34 and the second electrodes 36 are alternately arranged. In the illustrated example, the first electrodes 34 are provided in a manner to extend from the lower end to the central area of the piezoelectric element 30, and the second electrodes 36 are provided in a manner to extend from the upper end to an area near the bottom end of the piezoelectric element 30. Also, on the outer circumference of the piezoelectric element 30 is provided a first external electrode 38 that connects the first electrodes 32, and a second external electrode 40 that connects the second electrodes 34. Also, the short side of the piezoelectric element 30 is longer than the short side of the pressure chamber 12.

The piezoelectric elements 30 are arranged corresponding to the nozzle apertures 22, respectively, as shown in FIG. 1. In other words, the first piezoelectric elements 30*a* are arranged corresponding to the first nozzle apertures 22*a* of the first nozzle line 24, and the second piezoelectric elements 30*b* are arranged corresponding to the second nozzle apertures 22*b* of the second nozzle line 26. Accordingly, a first piezoelectric element line 44 is formed corresponding to the first nozzle line 24, and a second piezoelectric element line 46 is formed corresponding to the second nozzle line 26. In the illustrated example, the piezoelectric element lines 44 and 46 in two lines are provided in the Y direction. The positions of the piezoelectric elements 30 can be set in relation with the positions of the nozzle apertures 22 according to droplet ejection conditions.

The arrangement relation among the nozzle apertures 22 and among the piezoelectric elements 30, and the arrangement relation between the nozzle apertures 22 and the piezoelectric elements 30 can be summarized as follows.

As viewed in the X direction, the first nozzle aperture 22*a* is provided at a position that overlaps adjacent ones of the first nozzle apertures 22*a*, but provided at a position that does not overlap the second nozzle apertures 22*b*. As viewed in the X direction, the second nozzle aperture 22*b* is provided at a position that overlaps adjacent ones of the second nozzle apertures 22*b*, but provided at a position that does not overlap the first nozzle apertures 22*a*. Similarly, as viewed in the X direction, the first piezoelectric element 30*a* is provided at a position that overlaps adjacent ones of the first piezoelectric elements 30*a*, but provided at a position that does not overlap the second piezoelectric elements 30*b*. As viewed in the X direction, the second piezoelectric element 30*b* is provided at a position that overlaps adjacent ones of the second piezoelectric elements 30*b*, but provided at a position that does not overlap the first piezoelectric elements 30*a*.

As viewed in the X direction, the first nozzle apertures 22*a* are provided at positions that do not overlap the second piezoelectric elements 30*b*. Also, as viewed in the X direction, the second nozzle apertures 22*b* are provided at positions that do not overlap the first piezoelectric elements 30*a*.

Furthermore, in a plan view, the distance between adjacent ones of the first piezoelectric elements 30*a*, as viewed in the Y direction, is the same as the length of the short side of the second pressure chamber 12. Also, in a plan view, the distance between adjacent ones of the second piezoelectric elements 30*b*, as viewed in the Y direction, is the same as the length of the short side of the first pressure chamber 12*a*.

On the vibration plate 50 is provided a retaining member 70 for protecting the piezoelectric elements 30. Furthermore, spacers 60 are provided between the first piezoelectric element line 44 and the second piezoelectric element line 46 and between the second piezoelectric element line 46 and the retaining member 70, respectively.

The piezoelectric elements 30 may be formed by a known method described, for example, in Japanese Laid-open Patent Application JP-A-5-193129. The piezoelectric elements 30 may be formed by, for example, the following method. First, a first electrode 34 is formed on a first piezoelectric sheet by a screen printing method or the like. Then, a second electrode 36 is formed over the first piezoelectric sheet and the first electrode 34. The foregoing steps are repeated multiple times, thereby forming a laminate. The laminate is cut by a wire saw or the like, whereby a line of piezoelectric elements 30 in which the piezoelectric elements 30 are arranged at a predetermined pitch can be obtained. The material for the piezoelectric layers 32 is not particularly limited, and for example, perovskite type oxides such as lead zirconate titanate and the like may be used. The piezoelectric elements 30 may be formed from a combination of piezoelectric layers of different kinds.

According to the droplet ejection device 100 in accordance with the present embodiment, liquid such as ink is supplied from the reservoir 14 to the pressure chambers 12. Each of the pressure chambers 12 has a variable volume that can be changed by deformation of the vibration plate 30. Therefore, by applying a voltage to the piezoelectric element 30, the volume of the pressure chamber 12 can be changed, whereby liquid can be ejected from the nozzle aperture 22.

The droplet ejection device 100 in accordance with the present embodiment can be manufactured by a known method. For example, the droplet ejection device 100 may be obtained by the following manufacturing method.

A nozzle plate 20, a substrate 10 and vibration plate 50 are bonded together by adhesive or the like. Then, as shown in FIG. 2 through FIG. 5, a first laminate (not shown) for forming second piezoelectric elements 30*b* is disposed on the vibration plate 50, more specifically, on protrusions 52 of the vibration plate 50 which are located above the second pressure chambers 12*b*. The first laminate may be affixed to a spacer 60 affixed to a retaining member 70 by adhesive or other suitable method. The first laminate is cut by, for example, a wire saw, thereby forming a second line of piezoelectric elements 46. Similarly, a second laminate (not shown) similar to the first laminate is disposed on protrusions 52 of the vibration plate 50 which are located above first pressure chambers 12*a*. The second laminate may be affixed to a spacer 60 affixed to the second line of piezoelectric elements 46 by adhesive or other suitable method. The second laminate is cut by, for example, a wire saw, thereby forming a first line of piezoelectric elements 44. Then, a flexible wire substrate is connected to external electrodes 38 and 40. The method used for forming the first line of piezoelectric elements 44 and the second line of piezoelectric elements 46 is not limited to the method described above.

The droplet ejection device 100 in accordance with the present embodiment has the following characteristics.

The droplet ejection device 100 has multiple nozzle lines, more specifically, the first nozzle line 24 and the second nozzle line 26 in which nozzle apertures are arranged in the X direction, which are disposed in the Y direction, and the first nozzle apertures 22*a* and the second nozzle apertures 22*b* are arranged mutually shifted in the X direction. As a result, the substantial nozzle pitch in the X direction can be made smaller. For this reason, the nozzle apertures can be arranged at high density, and thus high-speed and high-resolution printing can be achieved.

Moreover, the piezoelectric elements 30*a* forming the first line of piezoelectric elements 44 are mutually separated by mechanically cutting the laminate by a wire saw or the like. For this reason, adjacent ones of the first piezoelectric elements 30 are inevitably spaced from each other by a width between them. In accordance with the present embodiment, the spaces between the first piezoelectric elements 30*a* thus formed are used for disposing the second line of piezoelectric elements 46. Therefore, without changing the nozzle pitch in a droplet ejection device in related art of the type described above, a plurality of nozzle lines can be disposed, such that the nozzle pitch can be made smaller, and the nozzles can be arranged at higher density, while retaining the size of the droplet ejection head.

In the illustrated embodiment, an example having two lines of piezoelectric elements is described. However, the invention is not limited to the above-described embodiment, and three or more lines of piezoelectric elements can be provided. Moreover, by mutually shifting the nozzle apertures in the piezoelectric element lines in the X direction, the substantial nozzle pitch can be made smaller, and higher density arrangement can be achieved.

2. Droplet Ejection Head

Figure 6:
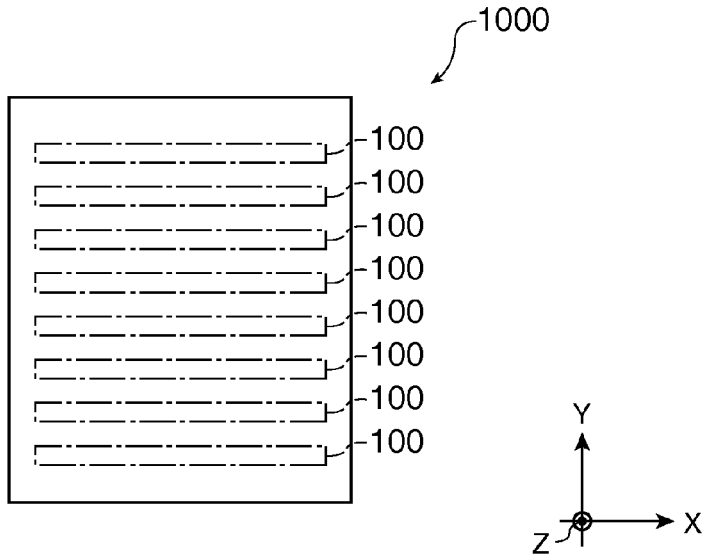
FIG. 6 is a schematic view showing a droplet ejection head in accordance with an embodiment of the invention.

A droplet ejection head in accordance with an embodiment of the invention may include a droplet ejection device in accordance with the embodiment of the invention. For example, as shown in FIG. 6, a plurality of droplet ejection heads 100 may be arranged in the Y direction, whereby a droplet ejection head 1000 that is capable of ejecting droplets of plural kinds can be formed. In the illustrated example, eight droplet ejection devices 100 are arranged. However, the number of droplet ejection devices 100 can be suitably set. Of course, the droplet ejection device 100 alone can be used as a single unit.

3. Printer

Next, a printer in accordance with an embodiment of the invention having a liquid jet head of the invention shall be described. The embodiment is described here using an example in which a printer 300 in accordance with the present embodiment is an ink jet printer.

Figure 7:
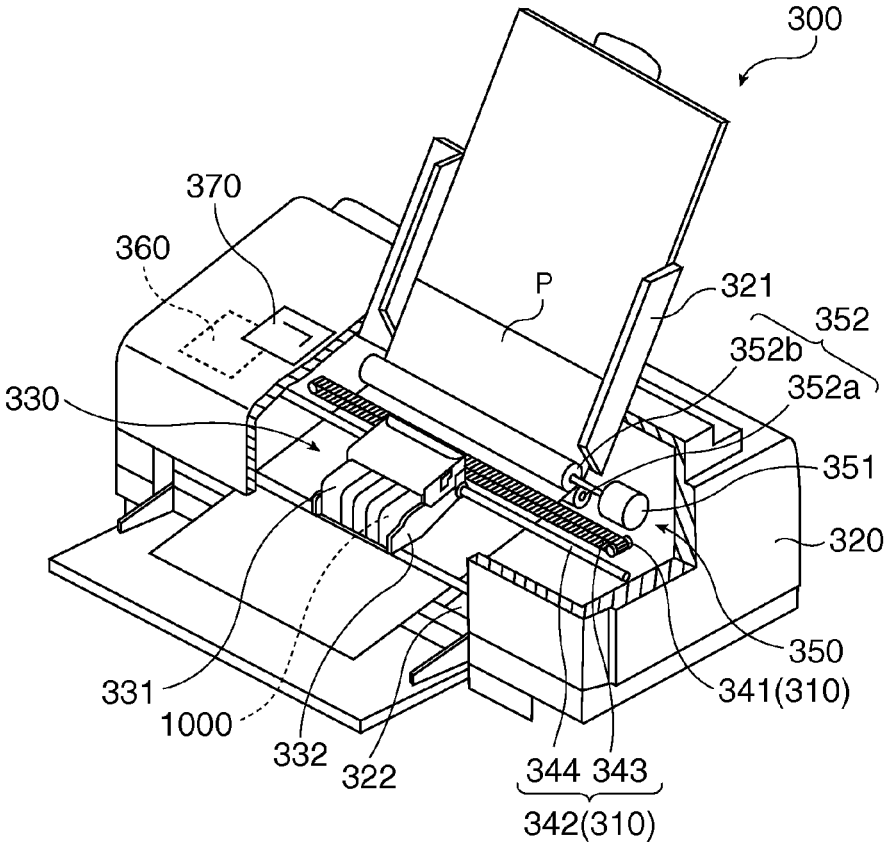
FIG. 7 is a schematic view of a printer in accordance with an embodiment of the invention.

FIG. 7 is a schematic perspective view of the printer 300 in accordance with the present embodiment.

The printer 300 includes a head unit 330, a driving section 310, and a controller section 360. Also, the printer 300 may include an apparatus main body 320, a paper feed section 350, a tray 321 for holding recording paper P, a discharge port 322 for discharging the recording paper P, and an operation panel 370 disposed on an upper surface of the apparatus main body 320.

The head unit 330 includes an ink jet recording head (hereafter simply referred to as the "head") that is formed from liquid jet heads 1000 of the embodiment described above. The head unit 330 is further equipped with ink cartridges 331 that supply inks to the head, and a transfer section (carriage) 332 on which the head and the ink cartridges 331 are mounted.

The driving section 310 is capable of reciprocally moving the head unit 330. The driving section 310 includes a carriage motor 341 that is a driving source for the head unit 330, and a reciprocating mechanism 342 that receives rotations of the carriage motor 341 to reciprocate the head unit 330.

The reciprocating mechanism 342 includes a carriage guide shaft 344 with its both ends being supported by a frame (not shown), and a timing belt 343 that extends in parallel with the carriage guide shaft 344. The carriage 332 is supported by the carriage guide shaft 344, in a manner that the carriage 332 can be freely reciprocally moved. Further, the carriage 332 is affixed to a portion of the timing belt 343. By operations of the carriage motor 341, the timing belt 343 is moved, and the head unit 330 is reciprocally moved, guided by the carriage guide shaft 344. During these reciprocal movements, ink is discharged from the head and printed on the recording paper P.

The control section 360 can control the head unit 330, the driving section 310 and the paper feeding section 350.

The paper feeding section 350 can feed the recoding paper P from the tray 321 toward the head unit 330. The paper feeding section 350 includes a paper feeding motor 351 as its driving source and a paper feeding roller 352 that is rotated by operations of the paper feeding motor 351. The paper feeding roller 352 is equipped with a follower roller 352*a* and a driving roller 352*b* that are disposed up and down and opposite to each other with a feeding path of the recording paper P being interposed between them. The driving roller 352*b* is coupled to the paper feeding motor 351. When the paper feeding section 350 is driven by the control section 360, the recording paper P is fed in a manner to pass below the head unit 330.

The head unit 330, the driving section 310, the control section 360 and the paper feeding section 350 are provided inside the apparatus main body 320.

The printer 300 has, for example, the following characteristics.

The printer 300 may have a liquid ejection head in accordance with an embodiment of the invention. The liquid jet head in accordance with the embodiment is highly reliable, and can be manufactured by a low cost and simple process. Therefore, the printer 300 that is highly reliable and can be manufactured by a low cost and simple process can be obtained.

It is noted that, in the example described above, an example in which the printer 300 is an ink jet printer is described. However, the printer in accordance with the invention may also be used as an industrial liquid ejection device. Liquid (liquid material) that may be ejected in this case may be liquid composed of any one of various kinds of functional materials whose viscosity is appropriately adjusted with a solvent or a dispersion medium.

The embodiments of the invention are described above in detail. However, those skilled in the art should readily understand that many modifications can be made without departing in substance from the novel matter and effects of the invention. Accordingly, all of those modified examples are deemed to be included in the scope of the invention.

What is claimed is:

1. A droplet ejection device comprising:

a substrate having a first pressure chamber, a second pressure chamber, a third pressure chamber and a fourth pressure chamber extending in a first direction;

a nozzle plate provided below the substrate, and having a first nozzle aperture continuous with the first pressure chamber, a second nozzle aperture continuous with the second pressure chamber, a third nozzle aperture continuous with the third pressure chamber, and a fourth nozzle aperture continuous with the fourth pressure chamber;

a vibration plate provided above the substrate;

a first piezoelectric element provided above the vibration plate and above the first pressure chamber;

a second piezoelectric element provided above the vibration plate and above the second pressure chamber;

a third piezoelectric element provided above the vibration plate and above the third pressure chamber; and a fourth piezoelectric element provided above the vibration plate and above the fourth pressure chamber, wherein, as viewed in a second direction orthogonal to the first direction, the first nozzle aperture is provided at a position that overlaps the third nozzle aperture, and provided at a position that does not overlap the second nozzle aperture and the forth nozzle aperture;

the second nozzle aperture is provided at a position that overlaps the fourth nozzle aperture, and provided at a position that does not overlap the first nozzle aperture and the third nozzle aperture, as viewed in the second direction;

the first piezoelectric element is provided at a position that overlaps the third piezoelectric element, and provided at a position that does not overlap the second piezoelectric element and the fourth piezoelectric element, as viewed in the second direction;

the second piezoelectric element is provided at a position that overlaps the fourth piezoelectric element, and provided at a position that does not overlap the first piezoelectric element and the third piezoelectric element;

the first, second, third, and fourth pressure chambers each have a long side and a short side, as viewed in a plan view;

the long side of the first pressure chamber has the same length as the long side of the third pressure chamber;

the long side of the second pressure chamber has the same length as the long side of the fourth pressure chamber; and the long side of the first pressure chamber is longer than the long side of the second pressure chamber.

2. A droplet ejection device according to claim 1, wherein the first nozzle aperture is provided at a position that does not overlap the second piezoelectric element and the fourth piezoelectric element as viewed in the second direction, and the second nozzle aperture is provided at a position that does not overlap the first piezoelectric element and the third piezoelectric element as viewed in the second direction.

3. A droplet ejection device according to claim 1, wherein the distance between the first piezoelectric element and the third piezoelectric element is the same as the length of the short side of the second pressure chamber, as viewed in the first direction in the plan view, and the distance between the second piezoelectric element and the fourth piezoelectric element is the same as the length of the short side of the third pressure chamber, as viewed in the first direction in the plan view.

4. A droplet ejection device according to claim 1, wherein the substrate further includes a reservoir; a first dam section that is provided in the first pressure chamber and provided at a flow inlet section where liquid flows from the reservoir to the first pressure chamber; a second dam section that is provided in the second pressure chamber and provided at a flow inlet section where liquid flows from the reservoir to the second pressure chamber; a third dam section that is provided in the third pressure chamber and provided at a flow inlet section where liquid flows from the reservoir to the third pressure chamber; and a fourth dam section that is provided in the fourth pressure chamber and provided at a flow inlet section where liquid flows from the reservoir to the fourth pressure chamber.

5. A droplet ejection device according to claim 1, wherein the substrate further include; a first dam section provided in the first pressure chamber; a second dam section provided in the second pressure chamber; a third dam section provided in the third pressure chamber; and a fourth dam section provided in the fourth pressure chamber, wherein the first dam section, the second dam section, the third dam section and the fourth dam section are provided at the same position as viewed in the second direction.

6. A droplet ejection device according to claim 1, wherein the first piezoelectric element has a long side and a short side, as viewed in the plan view, the second piezoelectric element has a long side and a short side, as viewed in the plan view, the third piezoelectric element has a long side and a short side, as viewed in the plan view, and the fourth piezoelectric element has a long side and a short side, as viewed in the plan view, wherein the short side of the first piezoelectric element is longer than the short side of the first pressure chamber, the short side of the second piezoelectric element is longer than the short side of the second pressure chamber, the short side of the third piezoelectric element is longer than the short side of the third pressure chamber, and the short side of the fourth piezoelectric element is longer than the short side of the fourth pressure chamber.

7. A droplet ejection device according to claim 6, wherein the vibration plate includes, above the vibration plate, a first protrusion located below the first piezoelectric element, a second protrusion located below the second piezoelectric element, a third protrusion located below the first piezoelectric element, and a fourth protrusion located below the first piezoelectric element.

8. A droplet ejection device according to claim 7, wherein the first protrusion is formed in the first piezoelectric element, as viewed in the plan view, the second protrusion is formed in the second piezoelectric element, as viewed in the plan view, the third protrusion is formed in the third piezoelectric element, as viewed in the plan view, and the fourth protrusion is formed in the fourth piezoelectric element, as viewed in the plan view.

9. A droplet ejection device according to claim 1, wherein the first piezoelectric element is provided at the same position as the third piezoelectric element, as viewed in the second direction, and the second piezoelectric element is provided at the same position as the fourth piezoelectric element, as viewed in the second direction.

10. A printer comprising the droplet ejection device set forth in claim 1.

* * * * *